US011516575B1

(12) United States Patent
Warlick

(10) Patent No.: US 11,516,575 B1
(45) Date of Patent: Nov. 29, 2022

(54) SLEEP-ENABLING HEADWEAR

(71) Applicant: Sandra Leigh Warlick, Asheville, NC (US)

(72) Inventor: Sandra Leigh Warlick, Asheville, NC (US)

( * ) Notice: Subject to any disclaimer, the term of this patent is extended or adjusted under 35 U.S.C. 154(b) by 0 days.

(21) Appl. No.: 17/347,669

(22) Filed: Jun. 15, 2021

(51) Int. Cl.
*H04R 1/10* (2006.01)

(52) U.S. Cl.
CPC ..... *H04R 1/105* (2013.01); *H04R 1/1016* (2013.01); *H04R 1/1083* (2013.01)

(58) Field of Classification Search
CPC ..... H04R 1/105; H04R 1/1016; H04R 1/1083
See application file for complete search history.

(56) References Cited

U.S. PATENT DOCUMENTS

| | | | | |
|---|---|---|---|---|
| 2,367,459 | A | 1/1945 | Corley | |
| 8,213,670 | B2 * | 7/2012 | Lai | H04R 5/0335 381/376 |
| 8,306,237 | B2 * | 11/2012 | Connor | G10K 11/1752 381/376 |
| 9,585,792 | B2 * | 3/2017 | Fairclough | A42B 1/0188 |
| 9,865,243 | B2 | 1/2018 | DeFranks | |
| 9,924,271 | B2 * | 3/2018 | Lai | H04R 1/1025 |
| 2005/0193477 | A1 * | 9/2005 | Penny | A42B 3/00 2/425 |
| 2006/0185062 | A1 * | 8/2006 | Peng | H04R 5/0335 2/209.13 |
| 2010/0054491 | A1 * | 3/2010 | Griffin | A61F 11/14 381/374 |
| 2013/0301845 | A1 * | 11/2013 | Royal | A61H 39/04 29/729 |
| 2013/0303837 | A1 * | 11/2013 | Berka | A61B 5/389 600/27 |
| 2014/0317849 | A1 | 10/2014 | LeGrand | |
| 2014/0321661 | A1 * | 10/2014 | Alao | H04R 1/105 381/74 |
| 2016/0000169 | A1 * | 1/2016 | Bryski | A41D 20/00 2/423 |
| 2016/0338636 | A1 * | 11/2016 | IDrees | A61B 5/6831 |
| 2016/0346129 | A1 | 12/2016 | Schaefer | |
| 2019/0090044 | A1 * | 3/2019 | Boesen | G10K 11/175 |
| 2020/0265824 | A1 * | 8/2020 | Kremer | G10K 11/17885 |

FOREIGN PATENT DOCUMENTS

| | | | | |
|---|---|---|---|---|
| CN | 213129424 U * | 5/2021 | | A61B 5/00 |
| DE | 19815038 A1 * | 2/1999 | | A42B 3/166 |
| WO | 2015051113 | 4/2015 | | |

* cited by examiner

*Primary Examiner* — Oyesola C Ojo

(57) ABSTRACT

The sleep-enabling headwear may comprise a headband, a left insert, a right insert, a left acoustic device, and a right acoustic device. The sleep-enabling headwear may be adapted to attenuate and/or mask ambient acoustic noise so that a user may sleep undisturbed. The headband may be adapted to hold the left insert, the right insert, the left acoustic device, the right acoustic device, or combinations thereof in place covering a user's ears. The left insert and the right insert may attenuate the ambient acoustic noise before the ambient acoustic noise reaches the user's ears. The left acoustic device and the right acoustic device may mask the ambient acoustic noise by playing an audio program into the user's ears.

16 Claims, 4 Drawing Sheets

SLEEP-ENABLING HEADWEAR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

FIELD OF THE INVENTION

The present invention relates to the fields of sleep promotion and headwear, more specifically, sleep-enabling headwear.

SUMMARY OF INVENTION

The sleep-enabling headwear may comprise a headband, a left insert, a right insert, a left acoustic device, and a right acoustic device. The sleep-enabling headwear may be adapted to attenuate and/or mask ambient acoustic noise so that a user may sleep undisturbed. The headband may be adapted to hold the left insert, the right insert, the left acoustic device, the right acoustic device, or combinations thereof in place over a user's ears. The left insert and the right insert may attenuate the ambient acoustic noise before the ambient acoustic noise reaches the user's ears. The left acoustic device and the right acoustic device may mask the ambient acoustic noise by playing an audio program into the user's ears.

An object of the invention is to provide a headband with pockets to hold inserts and devices in place over the user's ears.

Another object of the invention is to provide a left insert and a right insert that attenuate ambient acoustic noise.

A further object of the invention is to provide a left device and a right device that mask or actively cancel ambient acoustic noise by masking the ambient noise with an audio program or actively canceling the ambient noise using a phase-inverted signal derived from the ambient noise.

Yet another object of the invention is to provide a wireless interface to an external smart device such that an audio program sourced by the external smart device may be played against the user's ears.

These together with additional objects, features and advantages of the sleep-enabling headwear will be readily apparent to those of ordinary skill in the art upon reading the following detailed description of the presently preferred, but nonetheless illustrative, embodiments when taken in conjunction with the accompanying drawings.

In this respect, before explaining the current embodiments of the sleep-enabling headwear in detail, it is to be understood that the sleep-enabling headwear is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sleep-enabling headwear.

It is therefore important that the claims be regarded as including such equivalent construction insofar as they do not depart from the spirit and scope of the sleep-enabling headwear. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
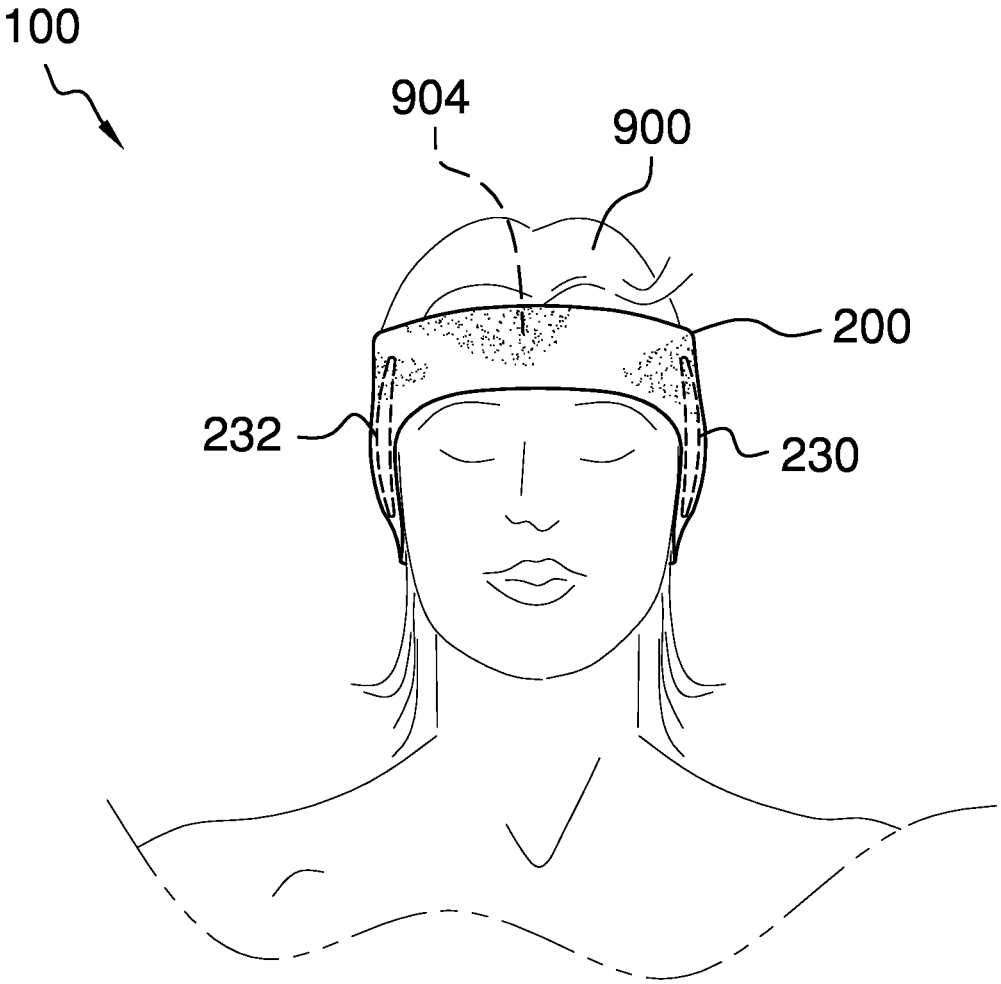
FIG. 1 is a front in-use view of an embodiment of the disclosure.
Figure 2:
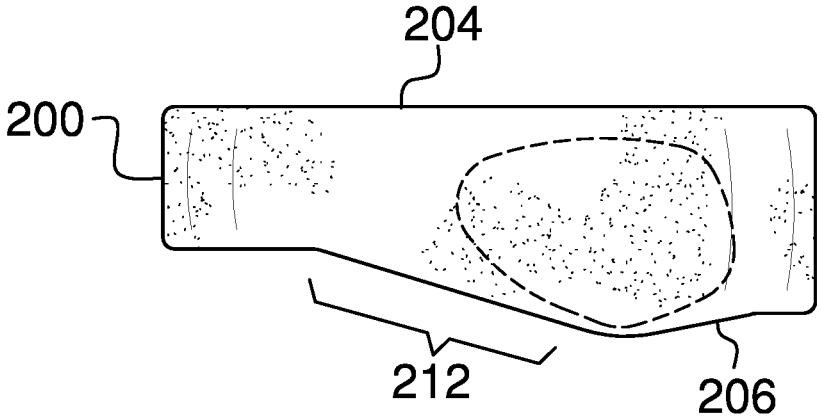
FIG. 2 is a side view of an embodiment of the disclosure.
Figure 3:
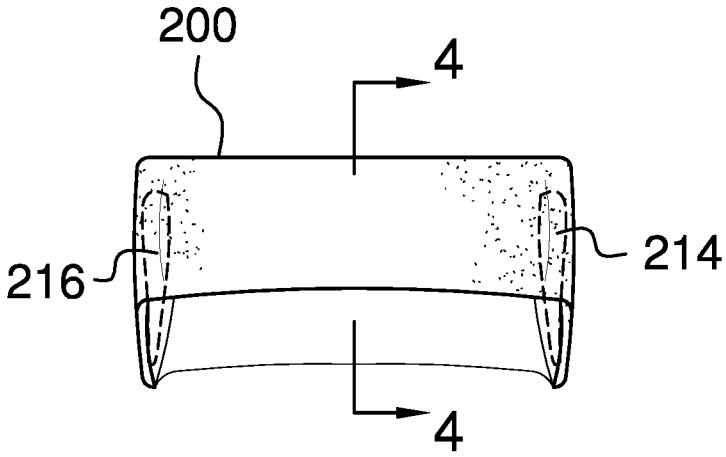
FIG. 3 is a front view of an embodiment of the disclosure.
Figure 4:
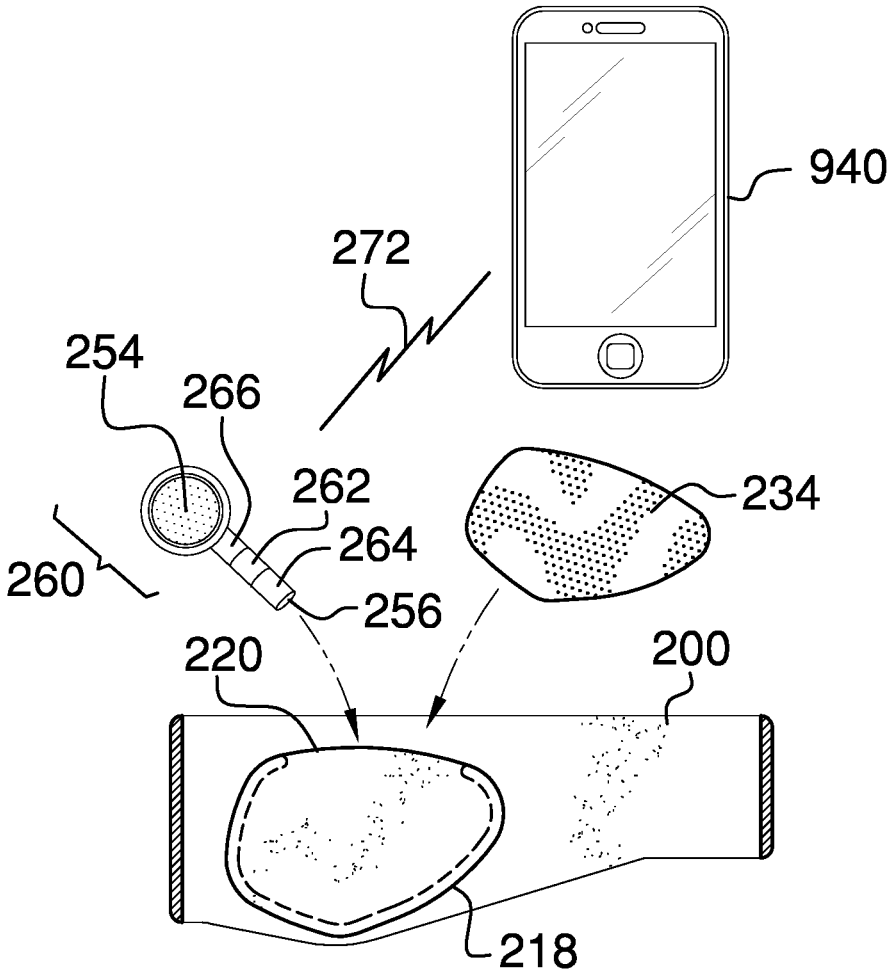
FIG. 4 is a cross-sectional view of an embodiment of the disclosure across 4-4 as shown in FIG. 3.
Figure 5:
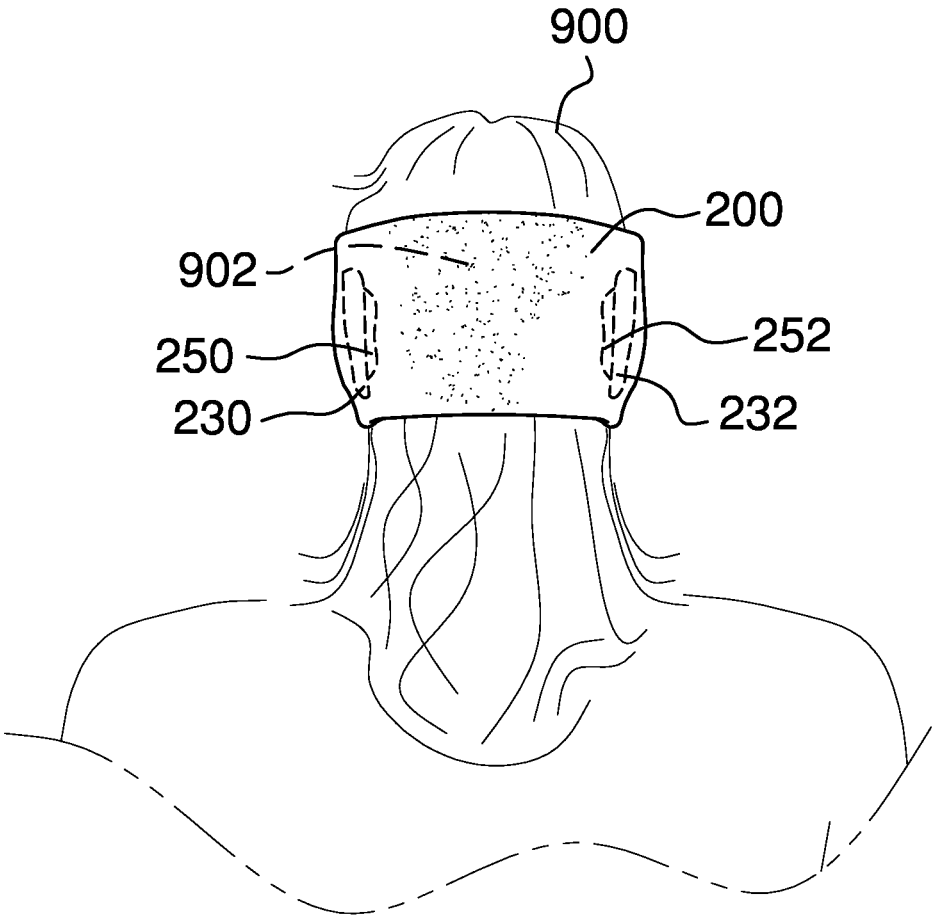
FIG. 5 is a rear in-use view of an embodiment of the disclosure.

Detailed reference will now be made to a first potential embodiment of the disclosure, which is illustrated in FIGS. 1 through 5.

The sleep-enabling headwear 100 (hereinafter invention) comprises a headband 200, a left insert 230, a right insert 232, a left acoustic device 250, and a right acoustic device 252. The invention 100 may be adapted to attenuate and/or mask ambient acoustic noise so that a user may sleep undisturbed. The headband 200 may be adapted to hold the left insert 230, the right insert 232, the left acoustic device 250, the right acoustic device 252, or combinations thereof in place over a user's ears. The left insert 230 and the right insert 232 may attenuate the ambient acoustic noise before the ambient acoustic noise reaches the user's ears. The left acoustic device 250 and the right acoustic device 252 may mask the ambient acoustic noise by playing an audio program into the user's ears to reduce the intelligibility of the ambient acoustic noise.

The headband 200 may be a loop of vertically oriented, flexible, elastic material. The headband 200 may be adapted to wrap around a user's head 900 to hold the left insert 230, the right insert 232, the left acoustic device 250, the right acoustic device 252, or combinations thereof in place. A top of the headband 204 may be horizontally level around the entire headband. A bottom of the headband 206 may vary in height with the portion covering a forehead 904 narrower than the portion covering a back of the head 902. The vertical height of the headband 200 may change in transition regions 212 covering a user's temples. The headband 200 may cover the user's ears.

The headband 200 may comprise a left inner pocket 214 and a right inner pocket 216. The left inner pocket 214 may be positioned on the left side of the headband 200 over a user's left ear. The right inner pocket 216 may be positioned on the right side of the headband 200 over the user's left ear. The left insert 230 may fit into the left inner pocket 214. The right insert 232 may fit into the right inner pocket 216.

An individual inner pocket 218 selected from the left inner pocket 214 and the right inner pocket 216 may be accessed via an access aperture 220 located on the inside of the headband 200.

The left insert 230 may be an acoustic attenuator adapted to be placed over the user's left ear. The left insert 230 may match the shape of the left inner pocket 214 such that the left insert 230 may fit into the left inner pocket 214. The right insert 232 may be an acoustic attenuator adapted to be placed over a user's right ear. The right insert 232 may match the shape of the right inner pocket 216 such that the right insert 232 may fit into the right inner pocket 216.

An individual insert 234 selected from the left insert 230 and the right insert 232 may attenuate the ambient acoustic noise by absorbing the ambient acoustic noise, by decoupling the ambient acoustic noise, by diffusing the ambient acoustic noise, by reflecting the ambient acoustic noise, or combinations thereof. As a non-limiting example, the individual insert 234 may absorb the ambient acoustic noise using a sound absorbing foam. As a non-limiting example, the sound absorbing foam may be a porous absorber such as an open cell rubber foam or melamine sponge.

The left acoustic device 250 may be adapted to be positioned over the user's left ear. The right acoustic device 252 may be adapted to be positioned over the user's right ear. The left acoustic device 250, the right acoustic device 252, or both may be held in place by the headband 200.

The left acoustic device 250 and the right acoustic device 252 may be electronic devices that play the audio program adjacent to the user's ears to mask the ambient acoustic noise. An individual acoustic device 260 selected from the left acoustic device 250 and the right acoustic device 252 may play the audio program via a sound transducer 254.

In some embodiments, the source of the audio program may be within the individual acoustic device 260. As a non-limiting example, the individual acoustic device 260 may comprise a noise generator circuit 262. The noise generator circuit 262 may produce an audio signal that may be played via the sound transducer 254. As non-limiting examples, the audio signal may encode white noise or pink noise. Playing the white noise or the pink noise may make the ambient acoustic noise less intelligible and therefore less distracting.

As an additional non-limiting example, the individual acoustic device 260 may comprise an active noise cancellation circuit 264. The active noise cancellation circuit 264 may convert the ambient acoustic noise into an electrical signal using a microphone 256, may invert the phase of the electrical signal to produce an inverted electrical signal, and may play the inverted electrical signal through the sound transducer 254. The audio program may be a reproduction of the ambient acoustic noise that is 180 degrees out of phase with the ambient acoustic noise such that the audio program destructively interferes with the ambient acoustic noise and thereby reduces the amplitude of the ambient acoustic noise.

In some embodiments, the source of the audio program may be external to the individual acoustic device 260. As a non-limiting example, the individual acoustic device 260 may comprise a receiver 266 operable to receive a wireless signal 272 from an external smart device 940. The wireless signal 272 may encode one or more musical pieces that may have a calming effect on the user. As non-limiting example, the external smart device 940 may be a smart phone, MP3 player, or another device capable of sourcing audible signals.

In some embodiments, the individual acoustic devices 260 may be coupled to the individual inserts 234 such that the individual inserts 234 may be operable to play the audio program from the individual inserts 234.

In use, the left insert 230 may be placed into the left inner pocket 214 and the right insert 232 may be placed into the right inner pocket 216 and the headband 200 may be placed around the user's head 900 such that the left insert 230 and the right insert 232 attenuate the ambient acoustic noise. Alternatively, the left acoustic device 250 and the right acoustic device 252, may be placed adjacent the user's ears and the headband 200 may be placed around the user's head 900. The left acoustic device 250 and the right acoustic device 252 may mask the ambient acoustic noise. Alternatively, the left insert 230, the right insert 232, the left acoustic device 250, the right acoustic device 252, or combinations thereof may be used simultaneously to attenuate and mask the ambient acoustic noise. When using the left acoustic device 250 and the right acoustic device 252, the audio program that masks the ambient acoustic noise may be sourced from within the individual acoustic devices 260 or may be sourced from the external smart device 940.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used herein, "encode" may refer to altering a signal, a message, or a dataset to embed information into the signal, the message, or the dataset. "Decode" may refer to extracting or recovering the information from the signal, the message, or the dataset. By way of example and not of limitation, the purpose of encoding and decoding may be to obfuscate the information during transmission or storage, to modulate a signal, to increase the efficiency of a communications or storage medium, or to convert one format into another format.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, a "microphone" may be a transducer that converts the energy from vibration into electrical energy. The sources of vibrations include, but are not limited to, acoustic energy.

As used in this disclosure, a "pocket" may be a pouch or storage space that is formed into an object. Pockets are often formed by joining a second textile or a second sheeting to a first textile or a first sheeting, respectively, by sewing or heat sealing respectively.

As used in this disclosure, a "transducer" may be a device that converts a physical quantity, such as pressure or brightness into an electrical signal or a device that converts an electrical signal into a physical quantity.

As used in this disclosure, "vertical" may refer to a direction that is parallel to the local force of gravity. Unless specifically noted in this disclosure, the vertical direction is always perpendicular to horizontal.

As used herein, "white noise" may refer to a random signal that has equal intensity at different frequencies. Audible white noise may be played in an environment to reduce the intelligibility of ambient background noise of the environment, thus masking the ambient background noise.

As used herein, "pink noise" may refer to a signal with a frequency spectrum such that the power spectral density (power per frequency interval) is inversely proportional to the frequency of the signal. In pink noise, each octave interval (halving or doubling in frequency) carries an equal amount of noise energy. Audible pink noise may be played in an environment to reduce the intelligibility of ambient background noise of the environment, thus masking the ambient background noise.

As used in this disclosure, "wireless" may be an adjective that is used to describe a communication channel that does not require the use of physical cabling.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A sleep-enabling headwear comprising:

a headband, a left insert, a right insert, a left acoustic device, and a right acoustic device;

wherein the sleep-enabling headwear is adapted to attenuate and/or mask ambient acoustic noise so that a user sleeps undisturbed;

wherein the headband is adapted to hold the left insert, the right insert, the left acoustic device, the right acoustic device, or combinations thereof in place over a user's ears;

wherein the left insert and the right insert are adapted to attenuate the ambient acoustic noise before the ambient acoustic noise reaches the user's ears;

wherein the left acoustic device and the right acoustic device are adapted to mask the ambient acoustic noise by playing an audio program adjacent the user's ears;

wherein the headband is a loop of elastic material;

wherein the headband is adapted to wrap around a user's head to hold the left insert, the right insert, the left acoustic device, the right acoustic device, or combinations thereof in place;

wherein a top of the headband is horizontally level around the entire headband;

wherein a bottom of the headband varies in height with the portion covering a forehead narrower than the portion adapted to cover a back of the head;

wherein the vertical height of the headband changes in transition regions adapted to cover a user's temples;

wherein the headband is adapted to cover the user's ears;

wherein the headband comprises a left inner pocket and a right inner pocket;

wherein the left inner pocket is adapted to be positioned on the left side of the headband over a user's left ear;

wherein the right inner pocket is adapted to be positioned on the right side of the headband over the user's right ear;

wherein the individual insert absorbs the ambient acoustic noise using a sound absorbing foam.

2. The sleep-enabling headwear according to claim 1 wherein the left insert fits into the left inner pocket;

wherein the right insert fits into the right inner pocket.

3. The sleep-enabling headwear according to claim 2 wherein an individual inner pocket selected from the left inner pocket and the right inner pocket is accessed via an access aperture located on the inside of the headband.

4. The sleep-enabling headwear according to claim 3 wherein the left insert is an acoustic attenuator adapted to be placed over the user's left ear;

wherein the left insert matches the shape of the left inner pocket such that the left insert fits into the left inner pocket.

5. The sleep-enabling headwear according to claim 4 wherein the right insert is an acoustic attenuator adapted to be placed over a user's right ear;

wherein the right insert matches the shape of the right inner pocket such that the right insert fits into the right inner pocket.

6. The sleep-enabling headwear according to claim 5 wherein an individual insert selected from the left insert and the right insert attenuates the ambient acoustic noise by absorbing the ambient acoustic noise, by decoupling the ambient acoustic noise, by diffusing the ambient acoustic noise, by reflecting the ambient acoustic noise, or combinations thereof.

7. The sleep-enabling headwear according to claim 6 wherein the sound absorbing foam is a an open cell rubber foam or melamine sponge.

8. The sleep-enabling headwear according to claim 6
wherein the left acoustic device is adapted to be positioned over the user's left ear;
wherein the right acoustic device is adapted to be positioned over the user's right ear;
wherein the left acoustic device, the right acoustic device, or both are held in place by the headband.

9. The sleep-enabling headwear according to claim 8
wherein the left acoustic device and the right acoustic device are electronic devices that are adapted to play the audio program adjacent to the user's ears to mask the ambient acoustic noise;
wherein an individual acoustic device selected from the left acoustic device and the right acoustic device plays the audio program via a sound transducer.

10. The sleep-enabling headwear according to claim 9
wherein the source of the audio program is within the individual acoustic device.

11. The sleep-enabling headwear according to claim 10
wherein the individual acoustic device comprises a noise generator circuit;
wherein the noise generator circuit produces an audio signal that is played via the sound transducer.

12. The sleep-enabling headwear according to claim 11
wherein the audio signal encodes white noise or pink noise.

13. The sleep-enabling headwear according to claim 10
wherein the individual acoustic device comprises an active noise cancellation circuit;
wherein the active noise cancellation circuit converts the ambient acoustic noise into an electrical signal using a microphone, inverts the phase of the electrical signal to produce an inverted electrical signal, and plays the inverted electrical signal through the sound transducer;
wherein the audio program is a reproduction of the ambient acoustic noise that is 180 degrees out of phase with the ambient acoustic noise such that the audio program destructively interferes with the ambient acoustic noise and thereby reduces the amplitude of the ambient acoustic noise.

14. The sleep-enabling headwear according to claim 9
wherein the source of the audio program is external to the individual acoustic device.

15. The sleep-enabling headwear according to claim 14
wherein the individual acoustic device comprises a receiver operable to receive a wireless signal from an external smart device.

16. The sleep-enabling headwear according to claim 9
wherein the individual acoustic devices are coupled to the individual inserts such that the individual inserts are operable to play the audio program from the individual inserts.

* * * * *